United States Patent [19]

Torr

[11] 4,086,678

[45] May 2, 1978

[54] GOLF CLUB TOOL

[76] Inventor: Calvin D. Torr, P.O. Box 726, Easton, Pa. 18042

[21] Appl. No.: 731,735

[22] Filed: Oct. 12, 1976

[51] Int. Cl.[2] ..... A63B 57/00

[52] U.S. Cl. ..... 15/105; 273/32 B; 15/236 R; 150/1.5 R

[58] Field of Search ..... 15/236 R, 105, 237; 273/32 B

[56] References Cited

U.S. PATENT DOCUMENTS

| | | | |
|---|---|---|---|
| 758,701 | 4/1904 | Hiles | 15/236 R |
| 790,228 | 5/1905 | Rohrer | 15/236 R |
| 1,377,484 | 5/1921 | Huneryager | 15/236 R |
| 2,013,545 | 9/1935 | Stevens | 15/236 R |
| 3,763,515 | 10/1973 | Voss | 15/236 R X |

FOREIGN PATENT DOCUMENTS

| | | | |
|---|---|---|---|
| 321,490 | 6/1920 | Germany | 15/236 R |

*Primary Examiner*—George J. Marlo
*Attorney, Agent, or Firm*—Zachary T. Wobensmith, 2nd; Zachary T. Wobensmith, III

[57] ABSTRACT

A hand held golf club tool is provided which is useful to clean mud and debris from the head of a golf club. The tool includes a flat portion on one end to scrape mud and debris from flat portions of the head and is provided with separated raised rib portions on the other end to clean mud and debris from the grooves in the golf club head. The tool may be made of magnetic reactive material which permits it to be detachably secured to a strip of magnetic material fastened to the side of the golf bag.

5 Claims, 5 Drawing Figures

FIG. 1
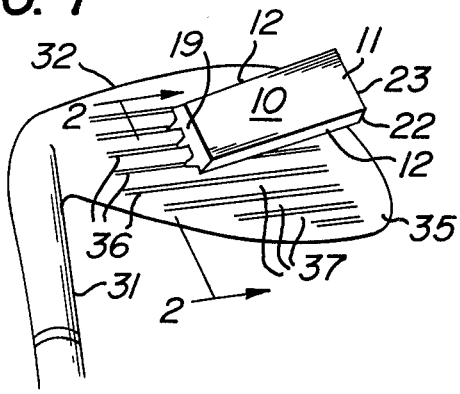
FIG. 2
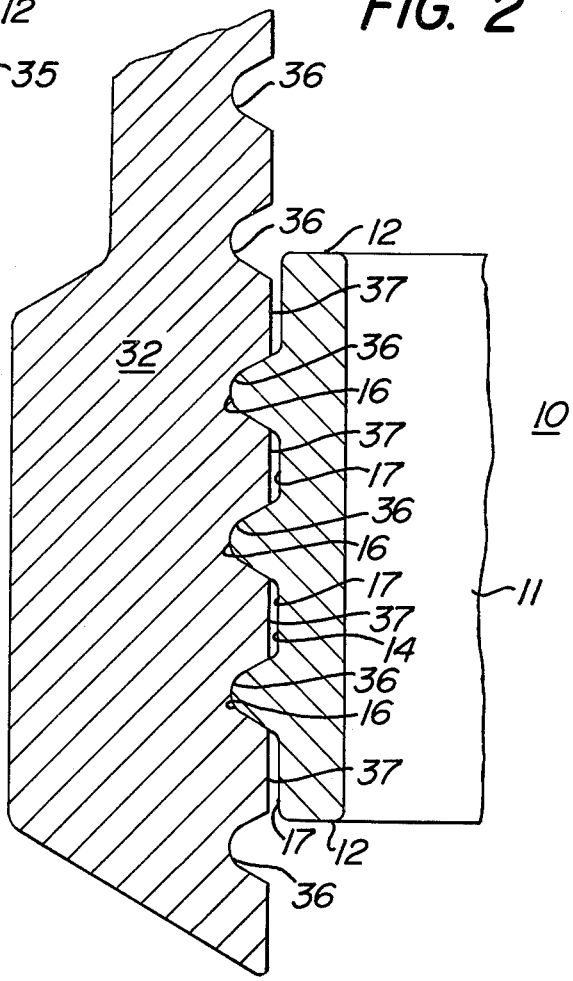
FIG. 3
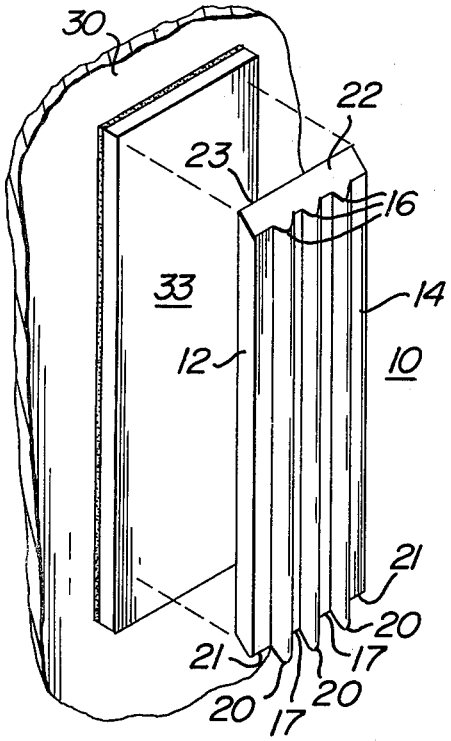
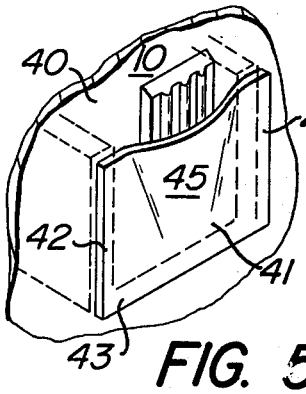
FIG. 5
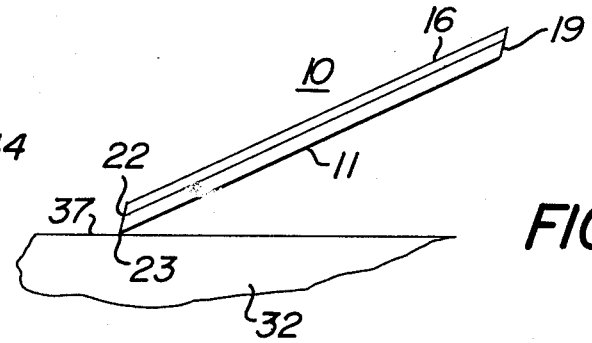
FIG. 4

GOLF CLUB TOOL

BACKGROUND OF THE INVENTION

1. Field of the Invention

This invention relates to a hand held tool for cleaning mud and debris from the head portions of golf clubs.

2. Description of the Prior Art

When golfing, many golfers often drive the head of the golf club into mud and other debris, some of which may cling to the club head. A golfer endeavors to strike the ball with the center portion of the club head so that for accuracy the striking portion must be of a consistent surface and therefore free from any debris thereon. The grooves in the face of a club head act to impart a controlled rotation of the ball during its momentary contact with the ball at impact, at which time the ball is compressed or slightly flattened against the club face. Without these grooves, or with the grooves filled or packed with mud or debris, the ball is not forced to rotate which brings about the desired flight of the ball. It is common practice for the golfer when faced with debris and mud deposits on the club head to attempt to clean the grooves in the head by using the pointed end of a golf tee, but this is not satisfactory as a tee is too soft and it does not remove debris from the flats between the grooves. Various other devices have been proposed which have comb-like surfaces, and/or a brush surface but none of them will conveniently remove debris from the grooves and the flats of a golf club head. In addition, none of the available devices are designed so that they can be comfortably held in the user's hand and still enter the grooves. The tool of my invention will quickly and easily remove debris from the grooves in a golf club head as well as the flats therebetween.

SUMMARY OF THE INVENTION

A hand held golf club tool for cleaning debris from the head of a golf club that includes a portion for cleaning the grooves in the head and a portion for cleaning the flat portions of the head. The tool may be made of magnetically reactive material which permits it to be detachably mounted to a magnetic strip secured to the side of a golf club bag.

The principal object of the invention is to provide a hand held golf club tool that is easy to use and highly effective to clean the debris from a golf club head.

A further object of the invention is to provide a hand held golf club tool that is simple and inexpensive to manufacture but durable in service.

A further object of the invention is to provide a hand held golf club tool that can be attached and detached from the golf club bag.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 1 is an isometric view of the tool of my invention, in use with a golf club head, FIG. 2 is a vertical sectional view taken approximately on the line 2—2 of FIG. 1, FIG. 3 is a view in perspective of the tool of my invention showing one manner of carrying the tool with a golf club bag, FIG. 4 is a fragmentary side elevational view of the tool of my invention in use with a golf club head, and FIG. 5 is a fragmentary perspective view of the tool of my invention showing another manner of carrying the tool with a golf club bag.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the golf club tool 10 as illustrated is of generally rectangular shape with a bottom surface 11, sides 12 and top surface 14. The bottom surface 11 of tool 10 can be flat and carry identifying words or marks thereon (not shown) to identify and distinguish the maker of the tool.

The top surface 14 includes longitudinal raised rib portions 16 separated by flat portions 17. The raised rib portions 16 in the preferred embodiment can be of a height of 1/32 of an inch separated from center to center a distance of approximately 0.143 inches and rounded in profile. One end 19 of the tool is cut back at an approximate 45° angle to the vertical as shown in FIG. 1 and rearwardly from the ribs 16 forming edges 20 along the ribs 16, and edges 21 along flats 17.

The tool 10 at the end 22, opposite to the end 19, is cut back at an approximate 45° angle to the vertical as shown in FIG. 4 to provide a continuous sharp edge 23. The tool 10 in the preferred embodiment can have a thickness of $\frac{1}{8}$ of an inch, a width of $\frac{5}{8}$ of an inch and a length of $1\frac{1}{4}$ inches. The tool 10 can be constructed of any preferred material, but magnetically responsive stainless steel of well known type has been found to be quite satisfactory.

Referring now to FIGS. 1, 2, and 3, a portion of a conventional golf bag 30 is illustrated with golf clubs 31 with heads 32 carried therein. The bag 30 has a strip of adhesively backed magnetic tape 33 of well known type fastened thereto which detachably retains the tool 10 thereon but which permits removal for use as desired.

Referring now to FIG. 5 a portion of a golf club bag 40 is illustrated which has a piece of cloth 41 secured thereto on three sides 42, 43, and 44 providing a pocket or pouch 45 to carry the tool 10 therein.

A typical golf club 31 with its head 32, is shown with its face 35 and transverse grooves 36 therein separated by flat portions 37. The grooves 36, as shown in FIGS. 1 and 2, have the ends 20 of the ribs 16 engaged therein and movement of the tool 10 acts to remove the debris from the grooves 36.

It has been found that an angle of 15° to 20° above the plane of the golf club face is the most satisfactory position for the user and provides for the easiest debris removal.

The tool edge 23 can be used to remove debris from flat portions 37 or from other portions of the club head as desired.

It should be noted that the edges 20, 21, and 23 can be renewed by sharpening, which provides for a long service life for the tool.

It will thus be seen that a tool has been provided with which the objects of my invention are achieved.

I claim:

1. A hand held golf club tool for cleaning mud and other debris from a golf club head having grooves and flat portions thereacross which comprises a rectangular body having top and bottom surfaces, at least one raised rib extending longitudinally along said top surface, said raised rib being of rounded configuration in cross section adapted to fit in one of said grooves, flat portions on said top surface on opposite sides of said rib, said tool being cut away at one end at a first angle less than 90° to said top surface to provide said rib and said flats with a sharp edge, and the end opposite to said last mentioned end being cut off at a second angle greater than 90° to said top surface to provide a sharp edge.

2. A hand held golf club tool as defined in claim 1 in which said first angle is of the order of 45°.

3. A hand held golf club tool as defined in claim 1 in which at least three ribs are provided on said top surface.

4. A hand held golf club tool as defined in claim 1 in which said bottom surface is smooth.

5. A hand held golf club tool as defined in claim 1 in which said tool is constructed of magnetically responsive material.

* * * * *

UNITED STATES PATENT OFFICE

CERTIFICATE OF CORRECTION

Patent No. 4,086,678 Dated May 2, 1978

Inventor(s) Calvin D. Torr

It is certified that error appears in the above-identified patent and that said Letters Patent are hereby corrected as shown below:

Column 2,

Line 36, after "of", "1¼" should be - 1-3/4 - .

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*